US005730542A

United States Patent [19]

Cheng

[11] Patent Number: 5,730,542

[45] Date of Patent: Mar. 24, 1998

[54] JOINT FOR A PLAYEN

[75] Inventor: Ying-Hsiung Cheng, Tainen Hsien, Taiwan

[73] Assignee: Top Fortune Ltd., San Diego, Calif.

[21] Appl. No.: 856,179

[22] Filed: May 14, 1997

[51] Int. Cl.[6] ..... F16C 11/10

[52] U.S. Cl. ..... 403/102; 403/100; 403/325; 5/98.1; 5/99.1

[58] Field of Search ..... 403/102, 101, 403/100, 91, 84, 117, 325, 321, 315; 200/25, 26; 5/99.1, 98.1, 98.3

[56] References Cited

U.S. PATENT DOCUMENTS 5,293,656 3/1994 Chan ..... 5/99.1
5,353,451 10/1994 Hsiung ..... 5/99.1
5,457,828 10/1995 Huang ..... 403/102 X
5,474,404 12/1995 Chien ..... 403/102
5,483,710 1/1996 Chan ..... 5/99.1
5,485,655 1/1996 Wang ..... 403/100 X
5,530,977 7/1996 Wang ..... 5/99.1
5,611,634 3/1997 Wang ..... 403/102

*Primary Examiner*—Harry C. Kim
*Attorney, Agent, or Firm*—Morton J. Rosenberg; David I. Klein; Jun Y. Lee

[57] ABSTRACT

A joint for a playpen includes a main base, two wing base at two sides of the main base and fixed with two frames of a playpen, a press block, and two plate hooks. The two plate hooks, fixed on the press block, have two barbs to engage a position pin of each wing base in a spread position of the playpen, preventing the joint from being collapsed even if the press block is accidentally pressed when the playpen is in the spread position, keeping the playpen in the spread position in a quite safe condition.

1 Claim, 12 Drawing Sheets

JOINT FOR A PLAYEN

BACKGROUND OF THE INVENTION

This invention relates to a joint for a playpen, particularly to one easy to collapse and spread, with high safety without possibility of accidental collapsing in a spread position.

A known conventional joint for a playpen shown in FIGS. 9 and 10 includes a extensible block 11 fixed in an end of a frame 10 and having a vertical end surface 111, a main base 20 shaped as an inverted U and having two ends respectively combined with a frame 10 of a playpen, a press block 21 provided to be located in a middle interior of the main base 20 and having an inverted V-shaped upper portion 211 and a rectangular block 22 respectively fixed on two sides of the press block 21.

When two frames 10, 10 of a playpen is spread out for using the playpen, the rectangular blocks 22, 22 have their upper edge in contact with the vertical surfaces 111 of the two extensible blocks 11, 11 fixed in the frames 10, 1O so that the two frames 10, 10 are kept in a horizontal position, i.e. in a spread position of the playpen.

When the known conventional joint is to be collapsed from the aforesaid spread position into a collapsed position, the press block 21 with the upper portion is pushed up, forcing the extensible blocks 11, 11 to shrink inward in the frames 10, 10, with the main base 20 moving down for the frames 10, 10 to be bent for collapsing. A dangerous disadvantage of this conventional joint is that the press block 21 may be accidental pressed down to be collapsed, causing danger to a baby playing in the playpen.

Another known conventional joint for a playpen shown in FIG. 11, 12 includes a right rod 30 and a left rod 40 combined together. The right rod 30 has a toothed inner annular surface 31 having teeth extending radially, a spring 32 and a toothed block 33 fitted in the space defined by the toothed inner annular surface 31 31 and able to move axially therein. The toothed block 33 has sector-shaped projections 331 to fit with sector projections 41 on a right side of the left rod 40. The left rod 40, the toothed block 33, the spring 32, and the right rod 30 are pivotally fixed together with a pivotal shaft 43 and a nut 13. A press block 44 has two projections 441, 441 on a right side for fitting through two holes 42, 42 provided in the left rod 40 and pushing the toothed block 33.

When the right rod 30 and the left rod 40 are aligned straight in a spread position, the toothed block 33 is in an engaged condition with the sector-shaped projections 41 of the left rod urged by the spring 321 so that the joint is kept immovable. But when the press block 44 is pressed with force, with the projections 441, 441 pushing the toothed block 33 to separate from the left rod 40, the right rod 30 and the left rod 40 are free to be swung for collapsing. This conventional joint has also a possible danger of the press block 44 being accidentally pressed to let the joint collapsed not on purpose, causing danger to a baby playing in the playpen.

SUMMARY OF THE INVENTION

The purpose of the invention is to offer a joint for a playpen, easy in handling and quite safe to use.

The main feature of the invention is a press block and two plate hooks fixed with the press block to move together. Each of two wing bases located at two sides of a main base has a position pin engaging one of two barbs of each plate hook so that two frames fixed with the two wing bases cannot be collapsed by accidental pressing of the press block of the joint in a spread position. Consequently possible danger of accidental collapsing may not occur to a playpen using the joints of the invention.

BRIEF DESCRIPTION OF DRAWINGS

This invention will be better understood by referring to the accompanying drawings, wherein.

DESCRIPTION OF THE PREFERRED EMBODIMENT

Figure 1:
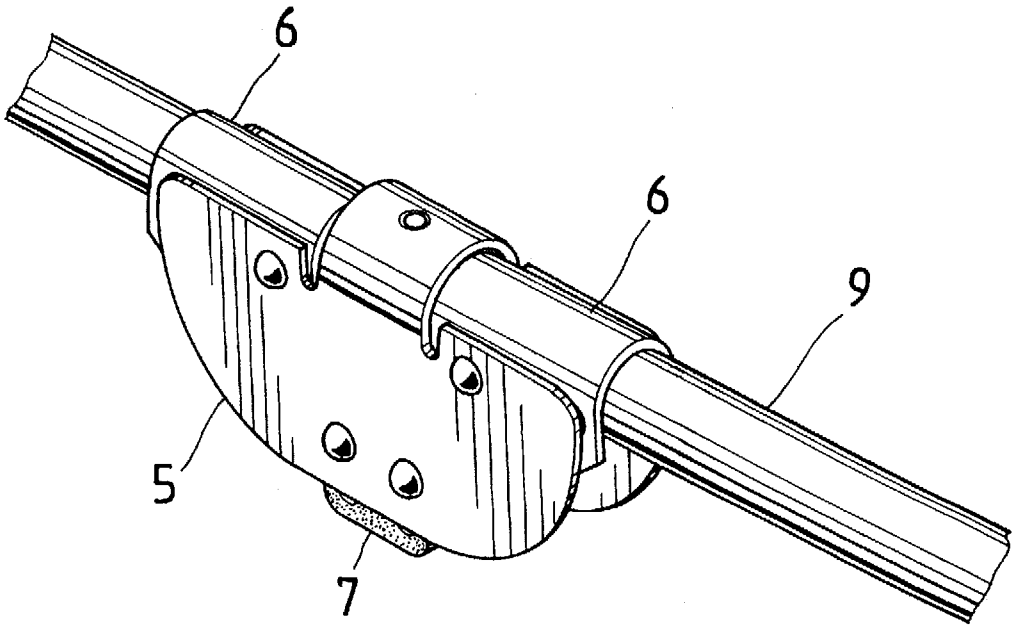
FIG. 1 is a perspective view of a joint for a playpen in the present invention.
Figure 2:
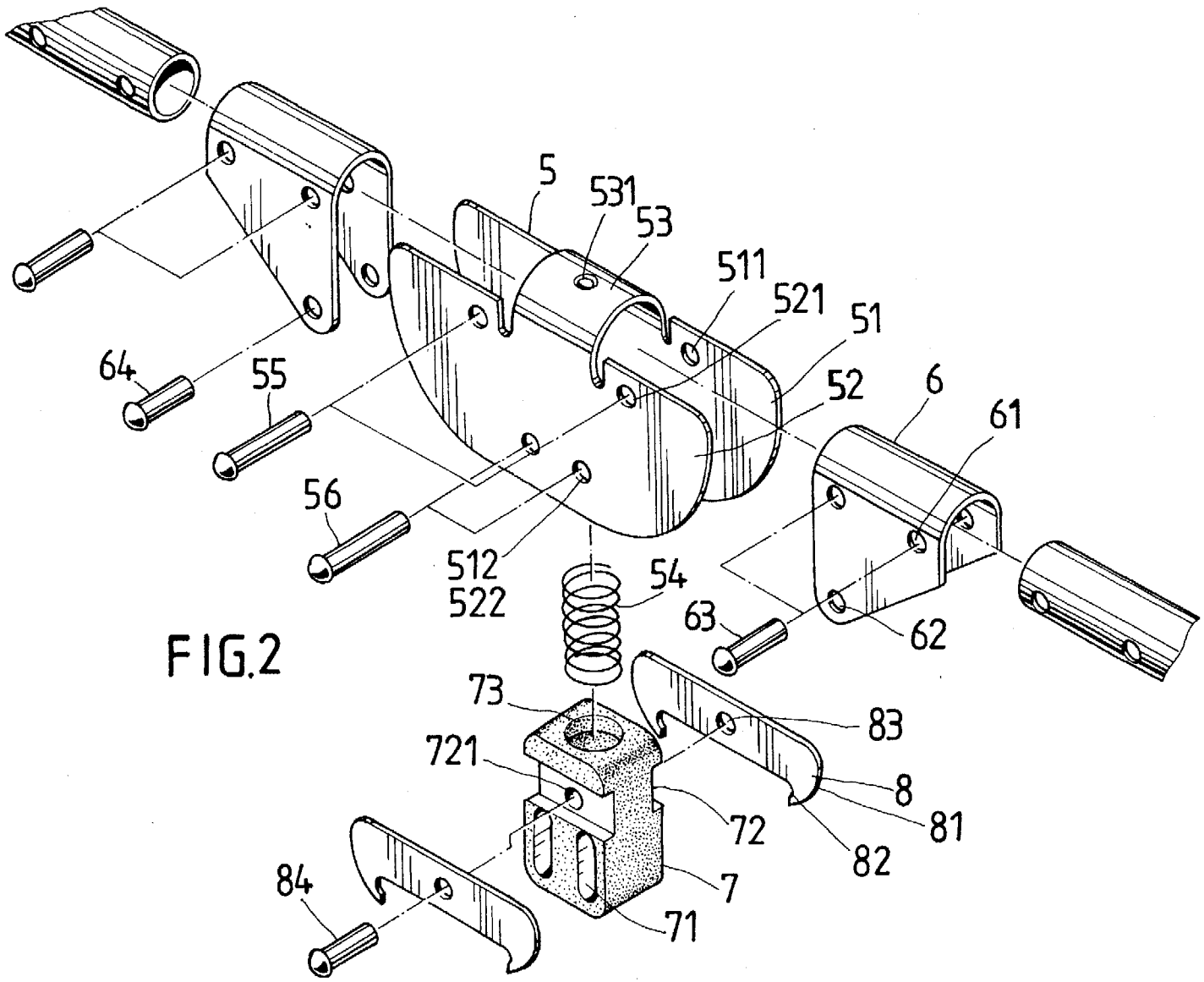
FIG. 2 is an exploded perspective view of the joint for a playpen in the present invention.

A preferred embodiment of a joint for a playpen in the present invention, as shown in FIGS. 1 and 2, includes a main base 5, two wing bases 6, 6, a press block 7, and two elongate plate hooks 8, 8 as main components combined together.

The main base 5 is formed of a U-shaped thin plate, two lengthwise side portions 51, 52 respectively formed with two opposite walls, a position hole 511, 521 respectively in the two opposite walls of the two side portions 51, 52 aligned with each other, an upper arch-shaped bridge 53 connecting an upper end of two lengthwise side portions 51, 52, two pairs of lower pin holes 512, 522 in two side walls between the side portions 51, 52, a center hole 531 with an annular curved-down edge 532 in the bridge 53, and a spring 54 having its upper end engaging the annular edge 532 and its lower end resting on an upper recess 73 of the press block 7.

Two wing bases 6, 6 are formed respectively of a U-shape plate, having two upper spaced apart position holes 61 in an upper end of two sides, and a position hole 62 in a lower end of two sides for a pin 64 to fit in for holding the two side walls securely. An end of a frame of playpen is inserted in the space between the two side walls and fixed firmly with position pins 63 fitting in the two upper position holes 61, 61 so that each wing base 6 can move together with the frame 9 in spreading and collapsing the joint. In addition, one of the two upper position holes 61 is aligned and pivotly connected with a position pin 63 with one of the two upper position holes of the main base 5 so that each wing base 6 can be swung relative to the main base 5.

The press block 7 has two vertical parallel slots 71, 71 spaced apart in a lower portion, a horizontal recess 72 respectively in two opposite sides and just on the slots 71, 71, a through hole 721 in the center of the recess 72, and a recess 73 in an upper surface for the lower end of the spring 54 to rest on. The press block 7 is deposited in the space under the arch-shaped bridge 53 of the main base 5, and combined with the main base 5 with two pins 56, 56 fitting in the lower position holes 512, 522 and through the two slots 71, 71 of the press block 7 so that the press block 7 can be moved up and down within the length of the vertical slots 71, 71 for collapsing the joint in a spread position into a collapsed position.

The two elongate plate hooks 8, 8 respectively have a guide curve 81 in two opposite ends, a barb 82 respectively extending inward down from the two ends, and a center hole 83 for a pin 84 to fit in and also in the through hole 721 to position the two plate hooks 8, 8 in the two recesses 72, 72 of the press block 7. Then the plate hooks 8, 8 move up and down with the press block 7.

Figure 3:
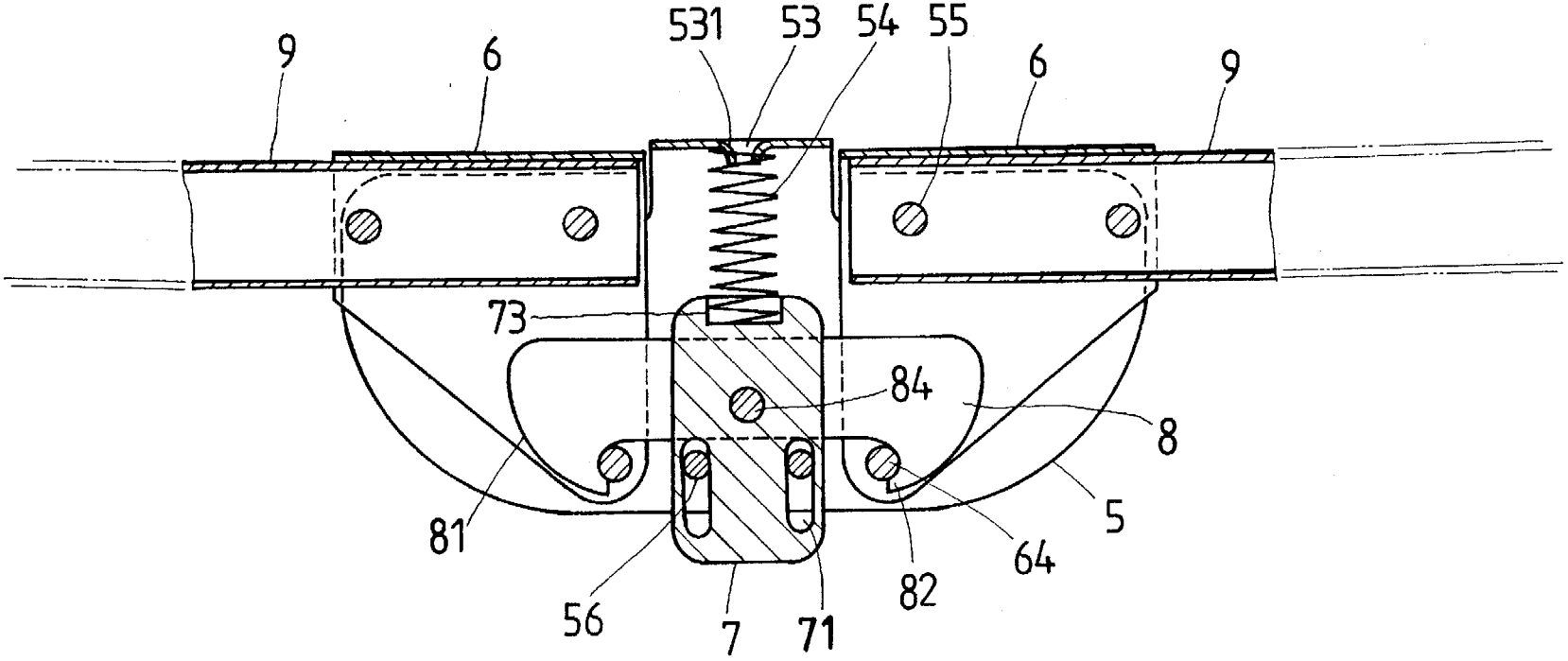
FIG. 3 is a cross-sectional view of the joint for a playpen in the present invention, assembled with a frame of a playpen.

In assembling, referring to FIGS. 1, 2 and 3, the hole 61 of the two wing bases 6, 6 are aligned to the upper position holes 511, 521 of the main base 5, and then the ends of two frames 9 of a playpen are inserted in the two wing bases 6, 6 and fixed therein with position pins 63 fitting in the holes 61 and the upper position holes 511, 521, thus connecting the frames 9, 9 with the wing bases 6, and with a fix pin 64 riveting tbe boles 62. Next, the two plate hooks 8, 8 are respectively fixed in the recesses 72, 72 of the press block 7 with the fix pin 84, and the press block 7 is fitted in the space under the bridge 53 between the two side portions 51, 52, with the lower end of the spring 54 resting on the recess 73, with the vertical slots 71, 71 aligned with the two lower position holes 512, 522 for a position pins 56, 56 to fit therein to restrict the press block 7 to move up and down within the length of the vertical slots 71, 71.

Figure 4:
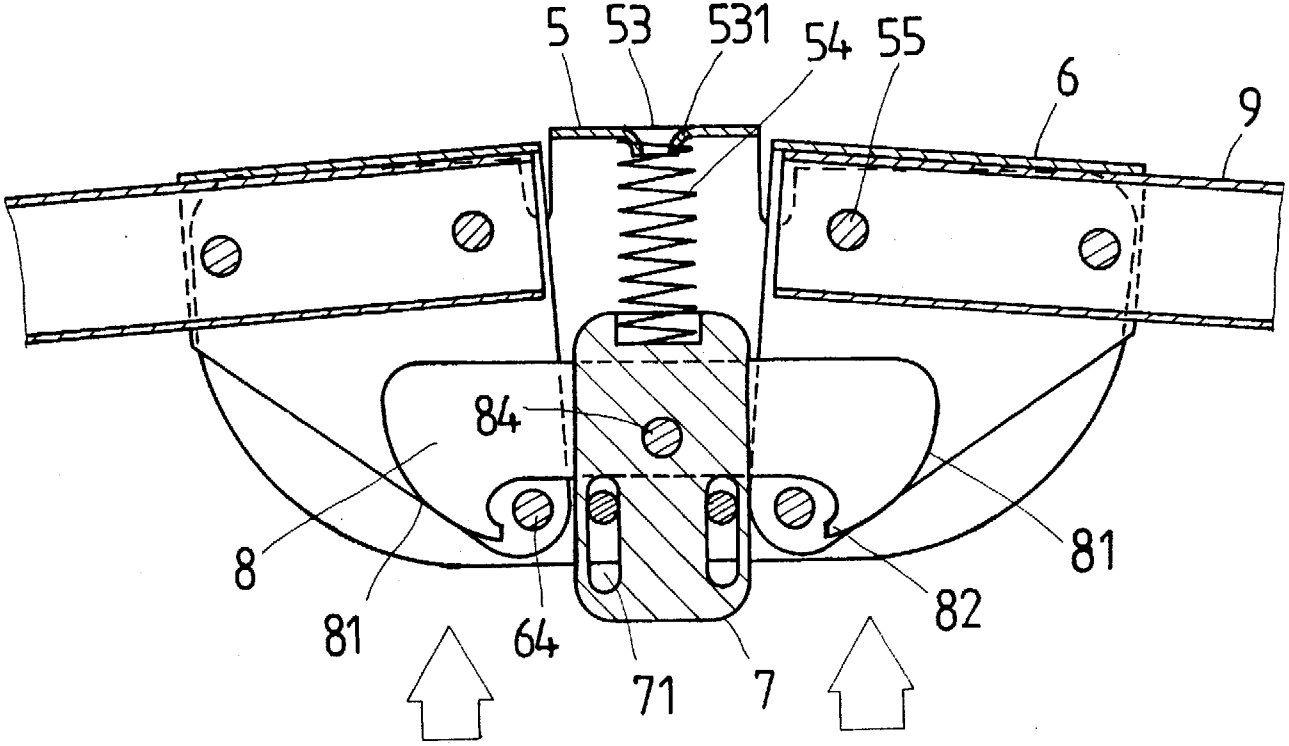
FIG. 4 is a cross-sectional view of the joint for a playpen in the present invention, showing it being collapsed with frames of a playpen for a first stage.

In using, referring to FIGS. 3 and 4, FIG. 3 shows the joint is in a spread position, with the two wing bases 6, 6 at the two sides of the main base 5 straightened to be aligned horizontally, with the position pins 64, 64 engaging the barbs 82, 82 of the two plate hooks 8. And in using the playpen, the weight of the frames 8 and a baby (or child) presses down the joint so that the position pins 64, 64 forcefully engage the barbs 82. So even if the press block 7 should be pressed down accidentally, engagement of the position pins 64, 64 and the barbs 82, 82 prevents the joint from collapsed.

Figure 5:
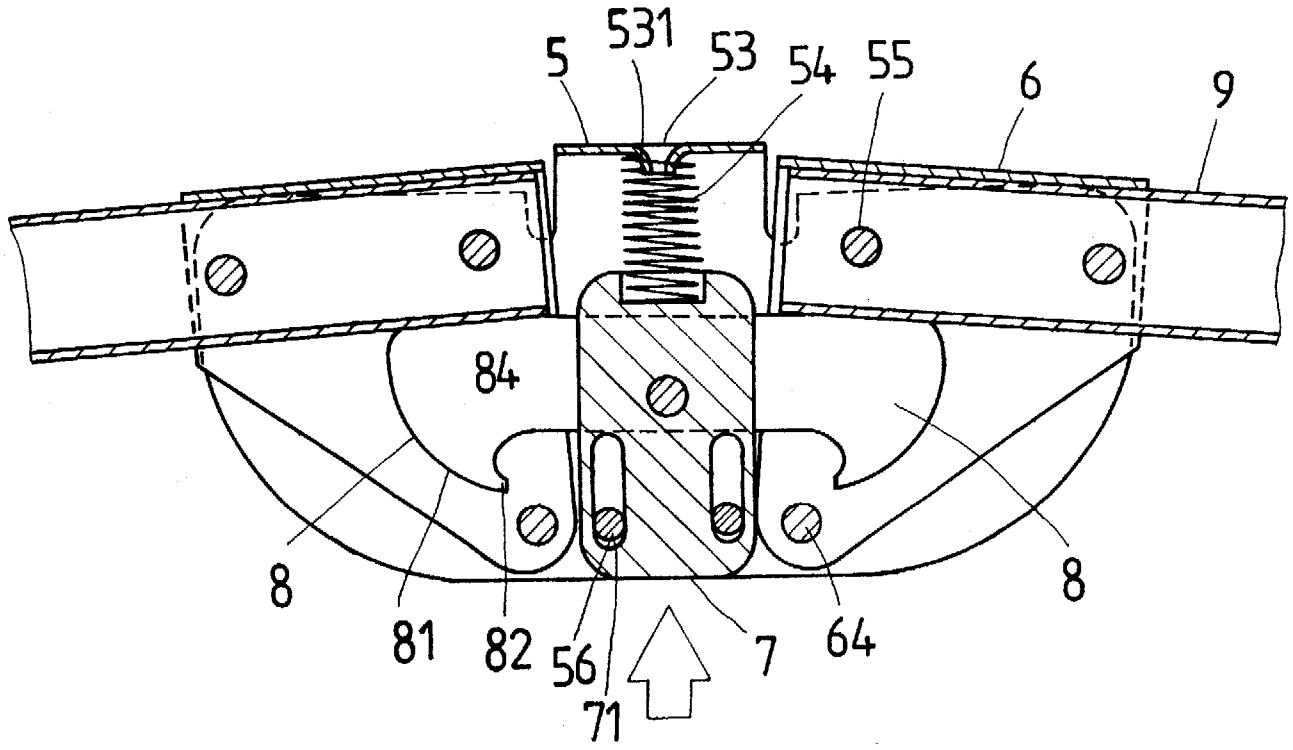
FIG. 5 is a cross-sectional view of the joint for a playpen in the present invention, showing it being collapsed with frames of a playpen for a second stage.
Figure 6:
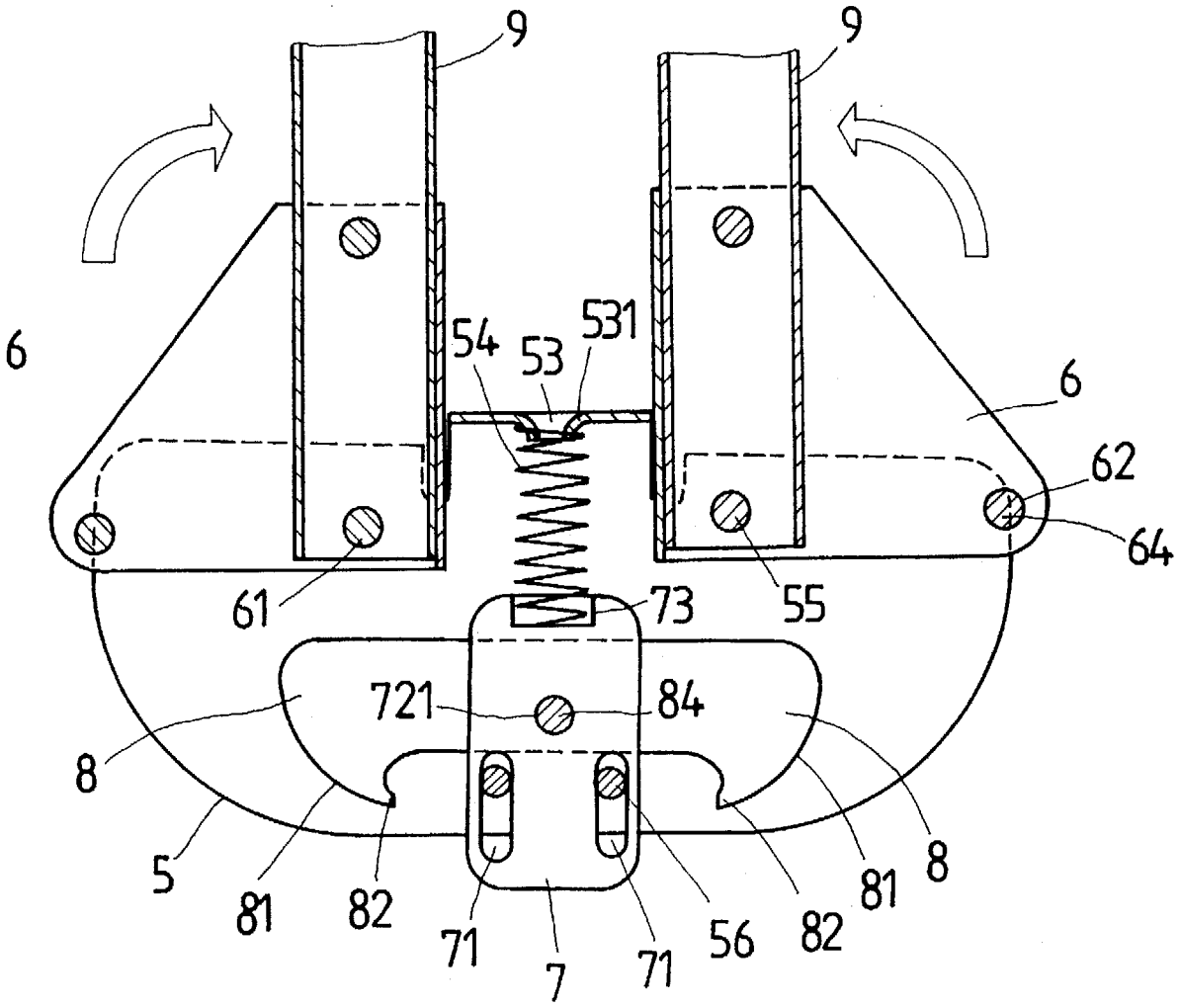
FIG. 6 is a cross-sectional view of the joint for a playpen in the present invention, showing it being bent with frames of a playpen for a third stage.

In collapsing the joint, FIGS. 4, 5 and 6 show various stages of collapsing. The main base 5 is wholly pushed up only a bit, forcing the two wing bases 6, 6 move to decline a bit relative to the main base 5 and form a very small angle to the main base 5, with the position pins 64, 64 separated from the barbs 8Z, 8Z. Then the user pushes the press block 7 upward from under, with the two plate hooks 8, 8 moved up by the press block 7, with the position pins 64, 64 completely separated from the barbs 82, 82, permitting the frames 9, 9 together with the wing bases 6, 6 bent upward to a collasped position shown in FIG. 6.

Figure 7:
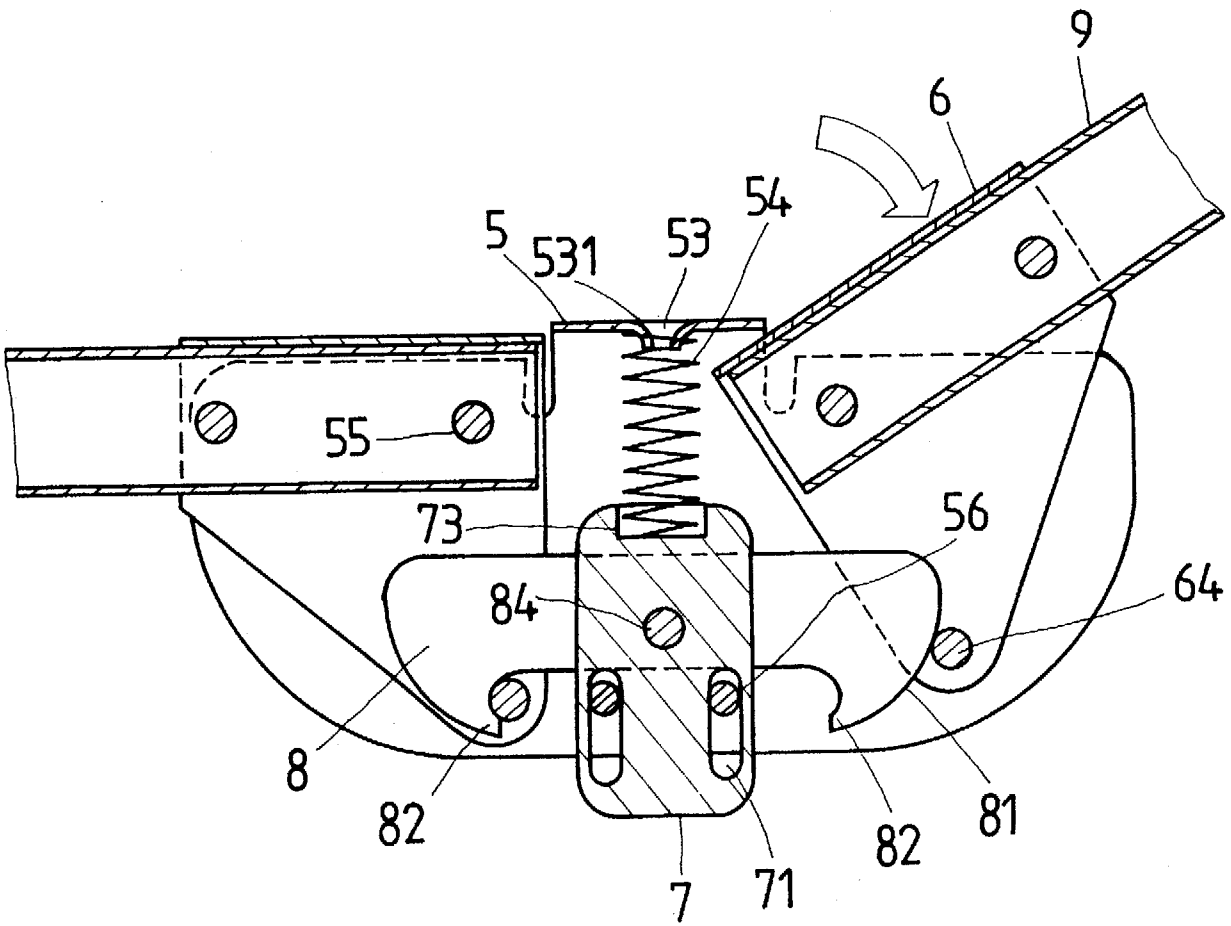
FIG. 7 is a cross-sectional view of the joint for a playpen in the present invention, showing it being spread with two frames separately handled.
Figure 8:
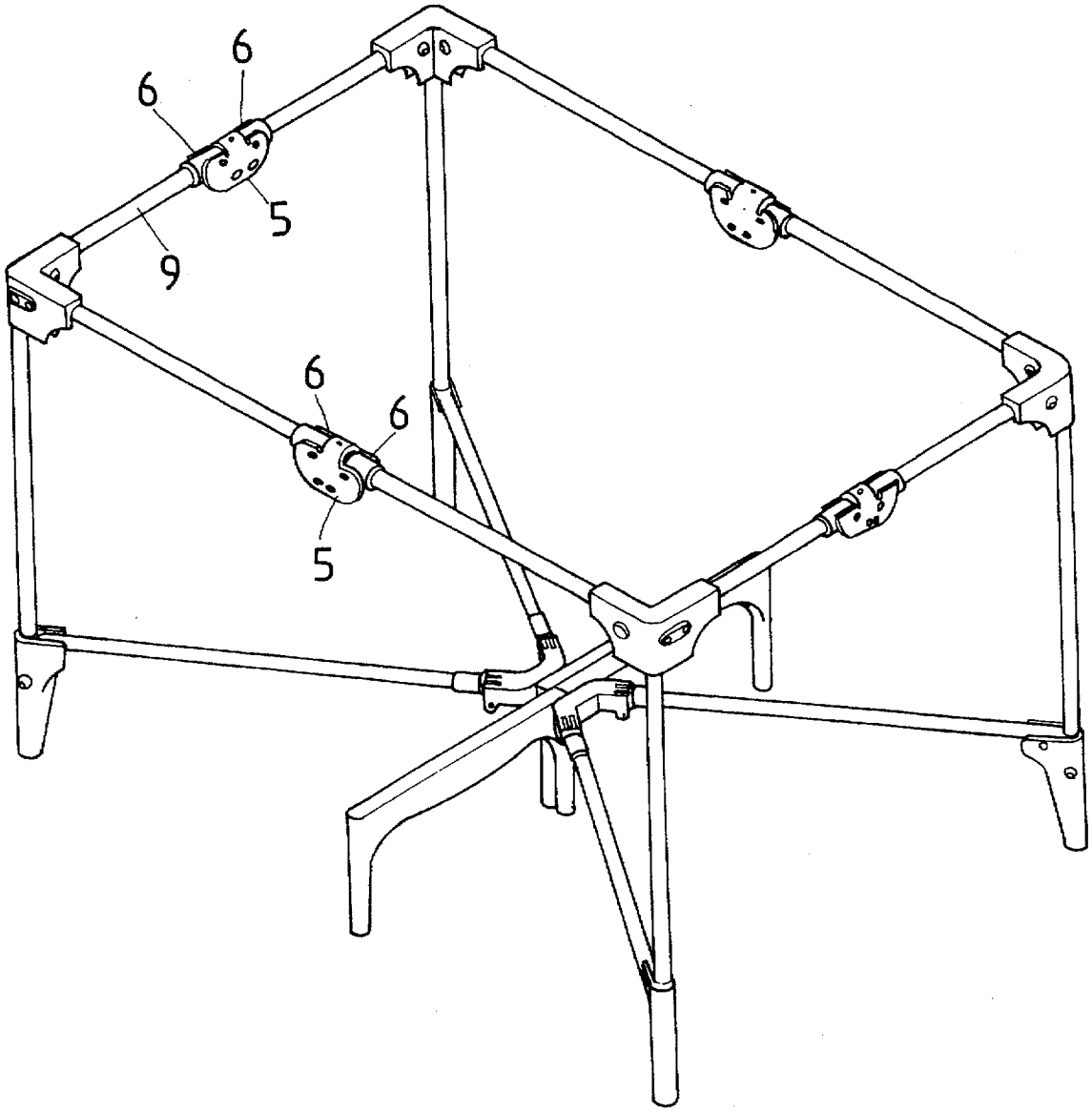
FIG. 8 is a perspective view of the joints for a playpen in the present invention, showing them assembled with frames of a playpen.
Figure 9:
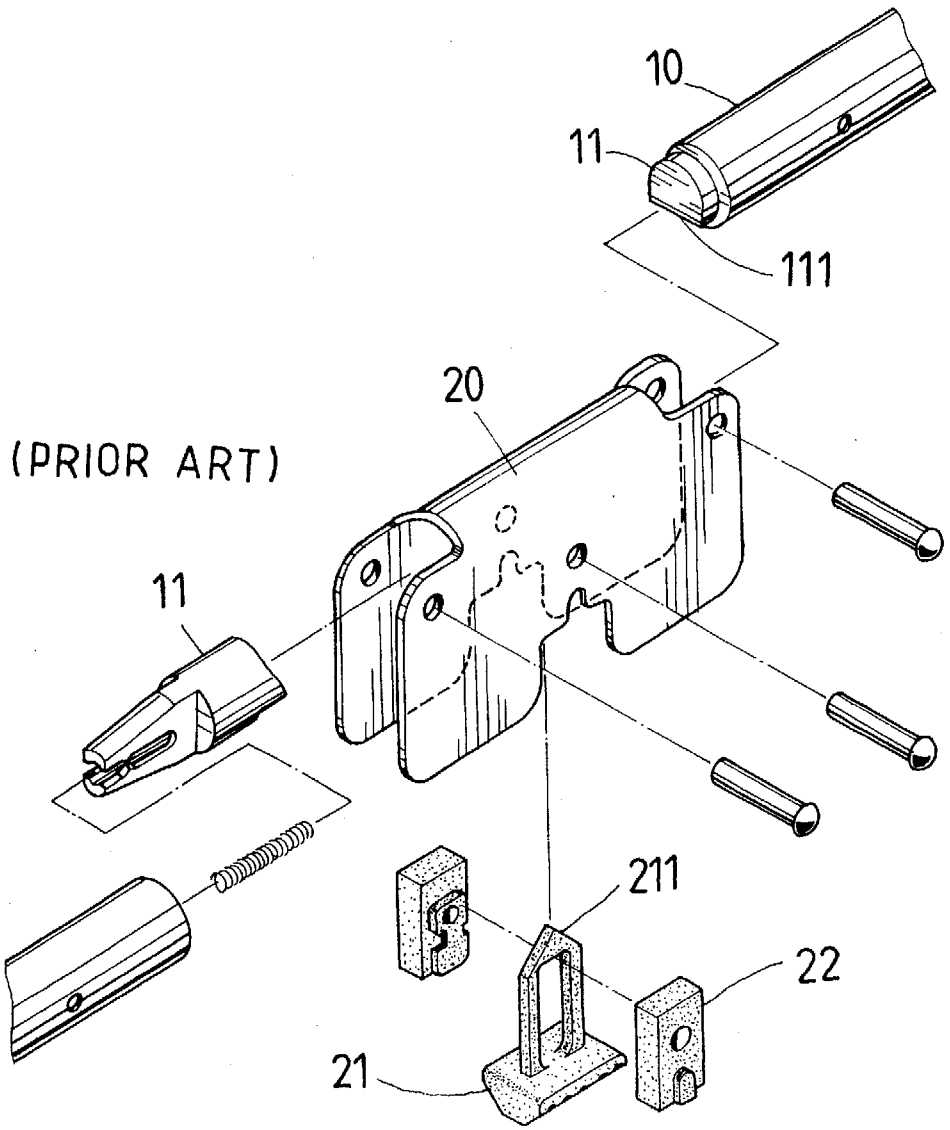
FIG. 9 (PRIOR ART)
FIG. 9 is an exploded perspective view of a first conventional joint for a playpen.
Figure 10:
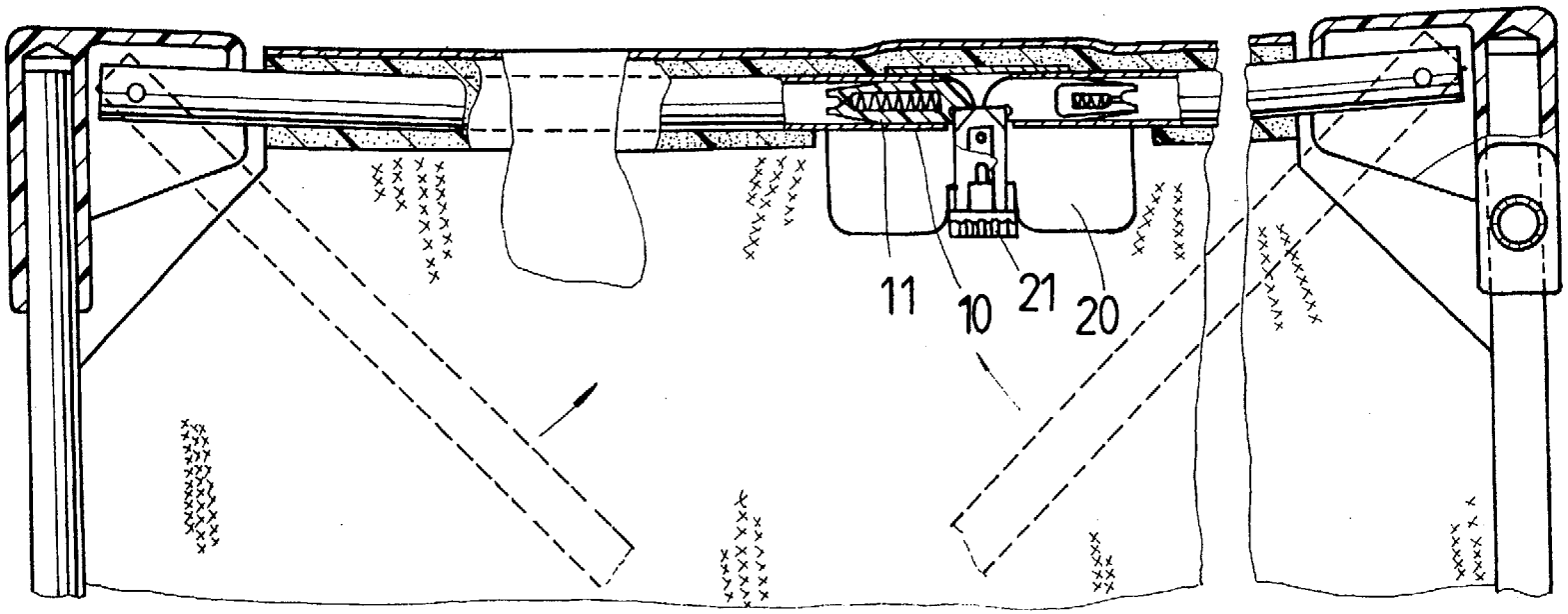
FIG. 10 (PRIOR ART)
FIG. 10 is a cross-sectional view of the first conventional joint assembled with a frame of a playpen.
Figure 11:
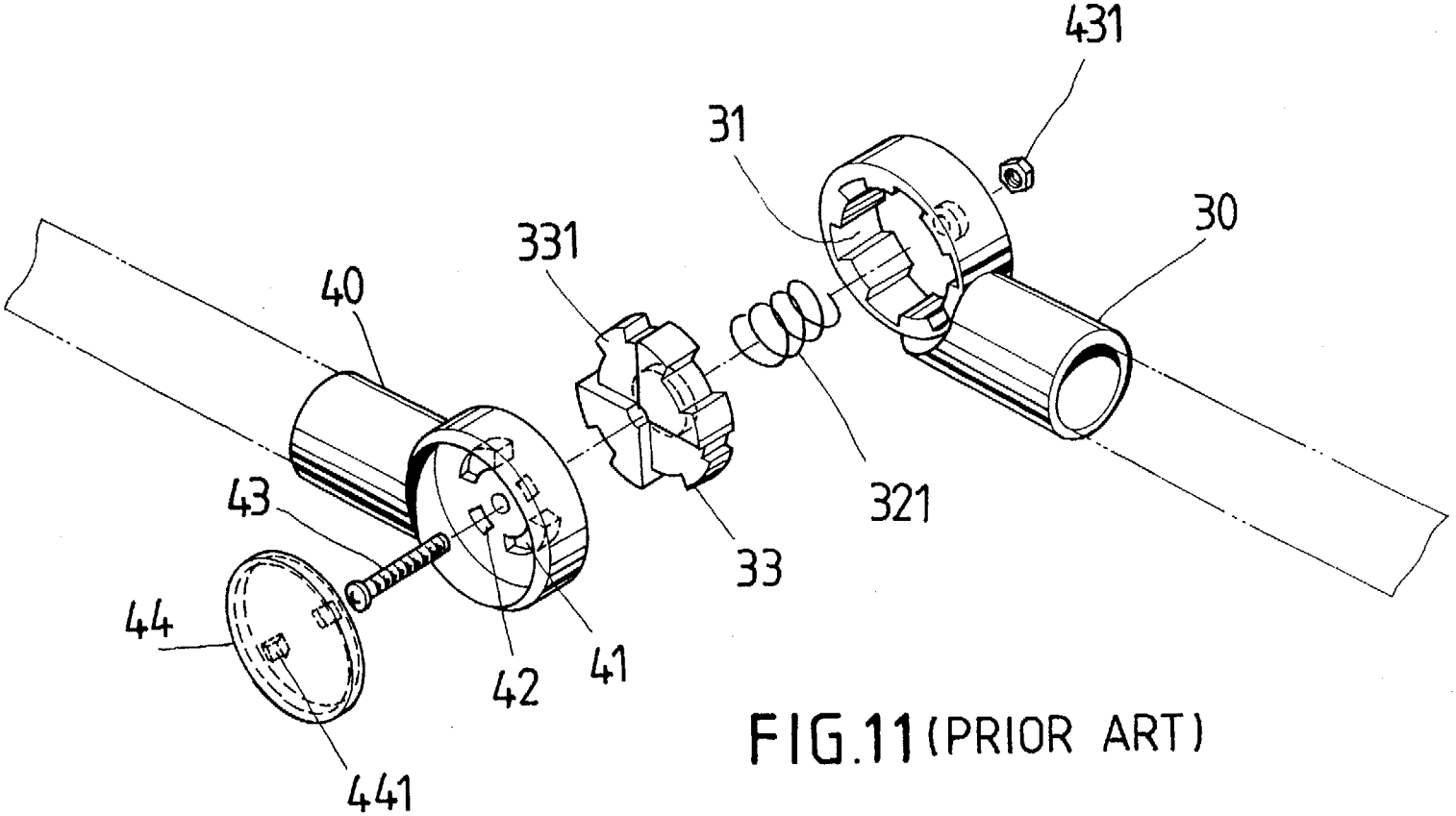
FIG.11 (PRIOR ART)
FIG. 11 is an exploded perspective view of a second conventional joint for a playpen; and, FIG. 12 is a perspective view of the second conventional joints assembled with frames of a playpen.
Figure 12:
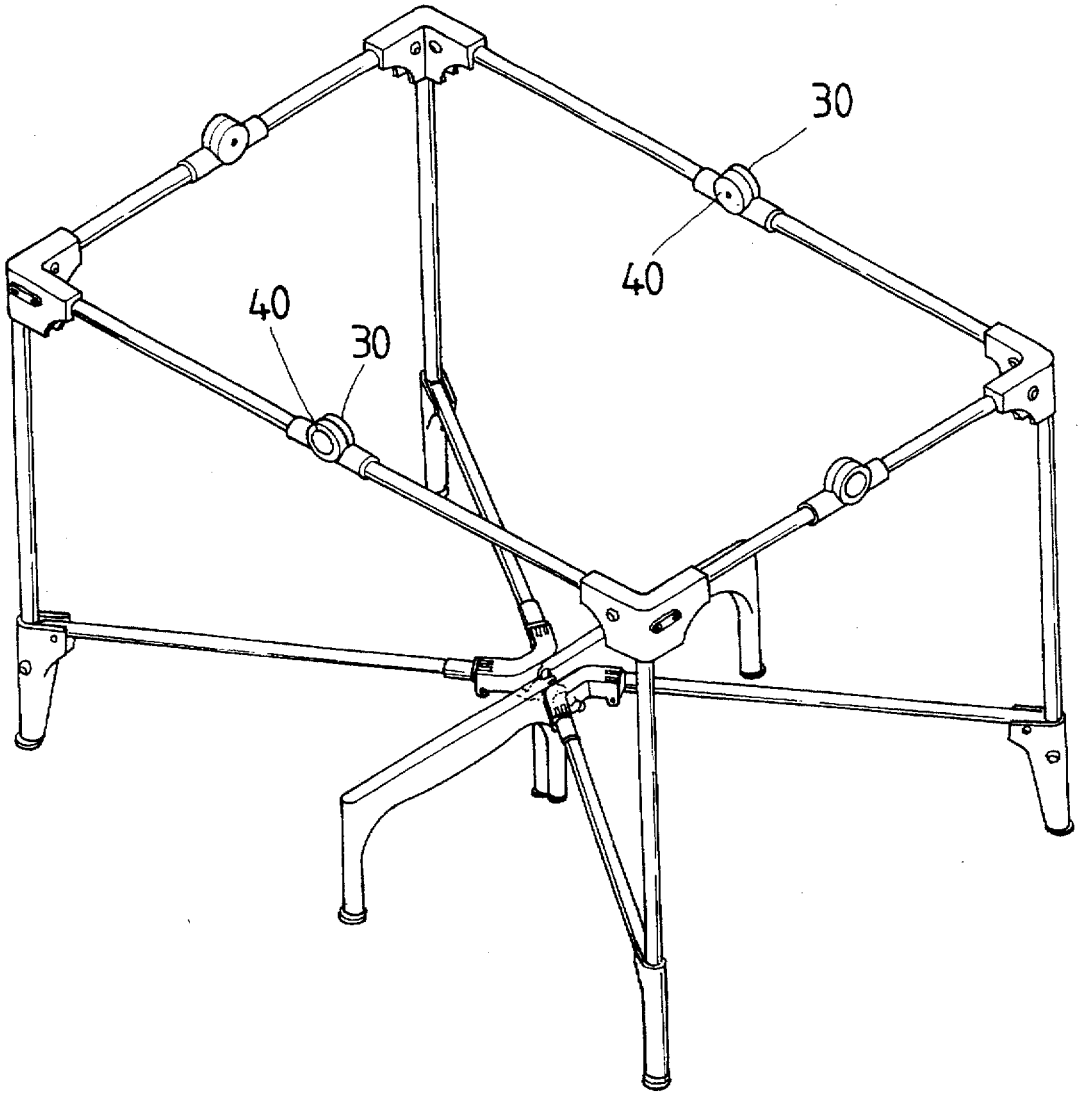
FIG.12 (PRIOR ART)

As the plate hooks 8, 8 have the guide curves 81, 81, the two frames 9, 9 can separately move along the guide curves 81, 84 to slide to let each position pin 64 move to engage the barb 82, facilitating the joint to be spread, as shown in FIG. 7.

As can be understood from the above description, the two plate hooks 8, 8 combined with the press block 7 can prevent the joint in the spread position from bent down by accidentally pressing the press block 7, by means of the barbs 82, 82 of the plate hooks 8, 8 and the position pins 64, 64 of the wing bases 6, 6. Then a playpen using the joints of the present invention can be quite safe, without possibility of accidental danger.

While the preferred embodiment of the invention bas been described above, it will be recognized and understood that various modifications may be made therein and the appended claims are intended to cover all such modifications which may fall within the spirit and scope of the invention.

What is claimed is:

1. A joint for a playpen comprising:

a main base made of a thin plate of an inverted U shape, having two parallel sides with an upper intermediate portion connected with an upper arch-shaped bridge, each said side having two position holes spaced apart in an upper end and two position holes in a lower end, a center hole provided in said arch-shaped bridge, said center hole having an annular curved-down edge for an upper end of a spring to engage with;

two wing bases respectively made of a thin plate of an inverted U shape, located at two opposite lengthwise sides of said main base, having two opposite side walls, each said side wall having two position holes spaced apart horizontally in an upper end and a position hole in a lower end, and an end of a frame of said playpen inserted in a space between said two side walls and firmly fixable with position pins fitting in said two upper position holes and two holes in said frame so that each said wing base may be moved together with said frame, one of said position pins of each wing base also fitting in one of said upper position holes of said main base so that each said wing base may swing relative to said main base with the position pin functioning as a pivot;

a press block, located in a space between said two sides of said main base below said bridge, having two vertical parallel slots in a lower portion, said two slots going from one side to the opposite side, a horizontal rectangular recess respectively on each of said two sides of said block, a through hole in the center of said two horizontal recesses, and a recess in an upper surface for a lower end of said spring engaging said center hole of said arch-shaped bridge to rest on, said spring located between said arch-shaped bridge and said press block so as to elastically urging said press block, said press block kept located in said main base by two position pins inserting through said two lower position holes of said main base and said two slots of said press block so that said press block may move up and down within the length of said slots;

two elongate plate hooks deposited respectively in said two horizontal recesses of said press block and moving up and down together with said press block, having a guide curve respectively in two ends, a barb formed to extend inward down from each said guide curve, and a center hole in the intermediate portion for a pin to fit in to fix said plate hooks on said press block; and, said two plate hooks having said two barbs engaging said two position pins of said two wing bases in a spread position of said joint, said barbs disengaging from said position pins in a collapsed position, said press block not able to be pressed down in case of said joint in the spread position by engagement of said barbs and said position pins so that accidental pressing on said press block cannot make said joint collapsed, maintaining said playpen using said joint in a quite safe condition.

* * * * *